US008468644B2

(12) United States Patent
Young

(10) Patent No.: US 8,468,644 B2
(45) Date of Patent: Jun. 25, 2013

(54) METHOD OF AND APPARATUS FOR CLEANING A FLOOR

(76) Inventor: Ronald Alexander (Scot) Young, Stourbridge (GB)

( * ) Notice: Subject to any disclaimer, the term of this patent is extended or adjusted under 35 U.S.C. 154(b) by 536 days.

(21) Appl. No.: 12/730,930

(22) Filed: Mar. 24, 2010

(65) Prior Publication Data

US 2010/0242992 A1 Sep. 30, 2010

(30) Foreign Application Priority Data

Mar. 25, 2009 (GB) ..... 0905053.5

(51) Int. Cl.
*A47L 13/58* (2006.01)

(52) U.S. Cl.
USPC ..... 15/260; 15/261; 15/228; 15/119.1

(58) Field of Classification Search
USPC ..... 15/119.1, 261, 228, 116.1, 260
See application file for complete search history.

(56) References Cited

U.S. PATENT DOCUMENTS

| | | | | |
|---|---|---|---|---|
| 2,199,906 | A * | 5/1940 | Bard | 15/261 |
| 5,419,015 | A * | 5/1995 | Garcia | 15/228 |
| 5,720,073 | A * | 2/1998 | Kamada | 15/261 |
| 2001/0013153 | A1 | 8/2001 | Zorzo | |
| 2002/0120997 | A1 * | 9/2002 | Alt | 15/261 |
| 2003/0056315 | A1 * | 3/2003 | Salmon | 15/261 |
| 2003/0167589 | A1 * | 9/2003 | Dingert et al. | 15/260 |
| 2008/0098548 | A1 | 5/2008 | Deerberg et al. | |

FOREIGN PATENT DOCUMENTS

| | | | |
|---|---|---|---|
| DE | 202 05 761 | U1 | 10/2002 |
| EP | 2 060 220 | A1 | 5/2009 |
| EP | 2 060 220 | A3 | 3/2010 |
| WO | 2006027046 | A1 | 3/2006 |

* cited by examiner

*Primary Examiner* — Saeed T Chaudhry
(74) *Attorney, Agent, or Firm* — Thedford I. Hitaffer; Hitaffer & Hitaffer, PLLC

(57) ABSTRACT

An apparatus for use in cleaning a floor uses a flat mop including a generally flat mop head having a handle and absorbent fabric material. The mop head is foldable to a folded condition, wherein a loop of the fabric material depends from the folded parts. The fabric material is inserted into cleaning liquid to wet the material. The mop head is introduced to a wringer to wring the material between the jaws and a wringing surface. The damp absorbent fabric material is used to mop the floor. The floor is dried using a separate drying tool that includes a head secured to a handle, and one or more attachment devices to attach a dry absorbent cloth to the head. The floor is dried by applying the cloth to the floor using the tool and moving a dry portion of the cloth over the floor.

6 Claims, 7 Drawing Sheets

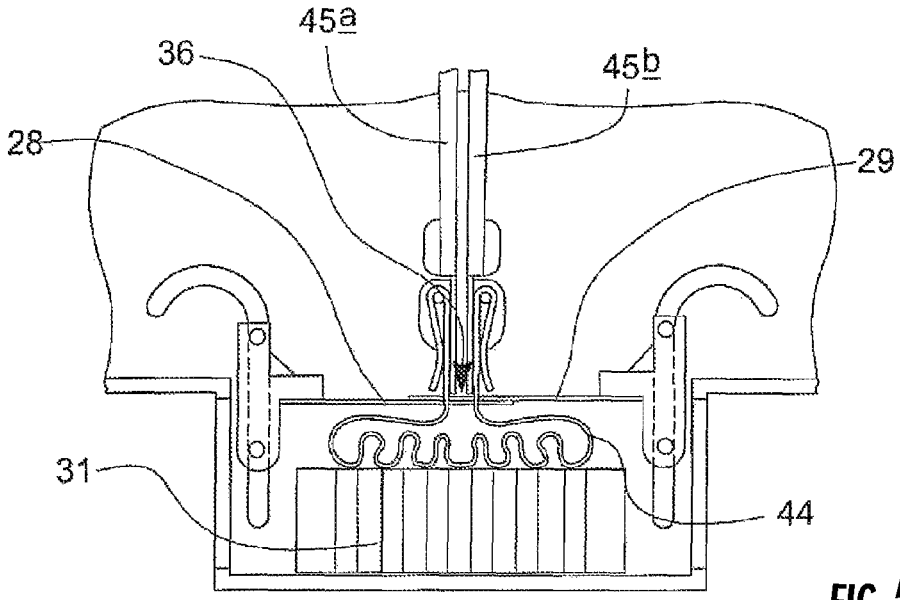
FIG. 5A
FIG. 6
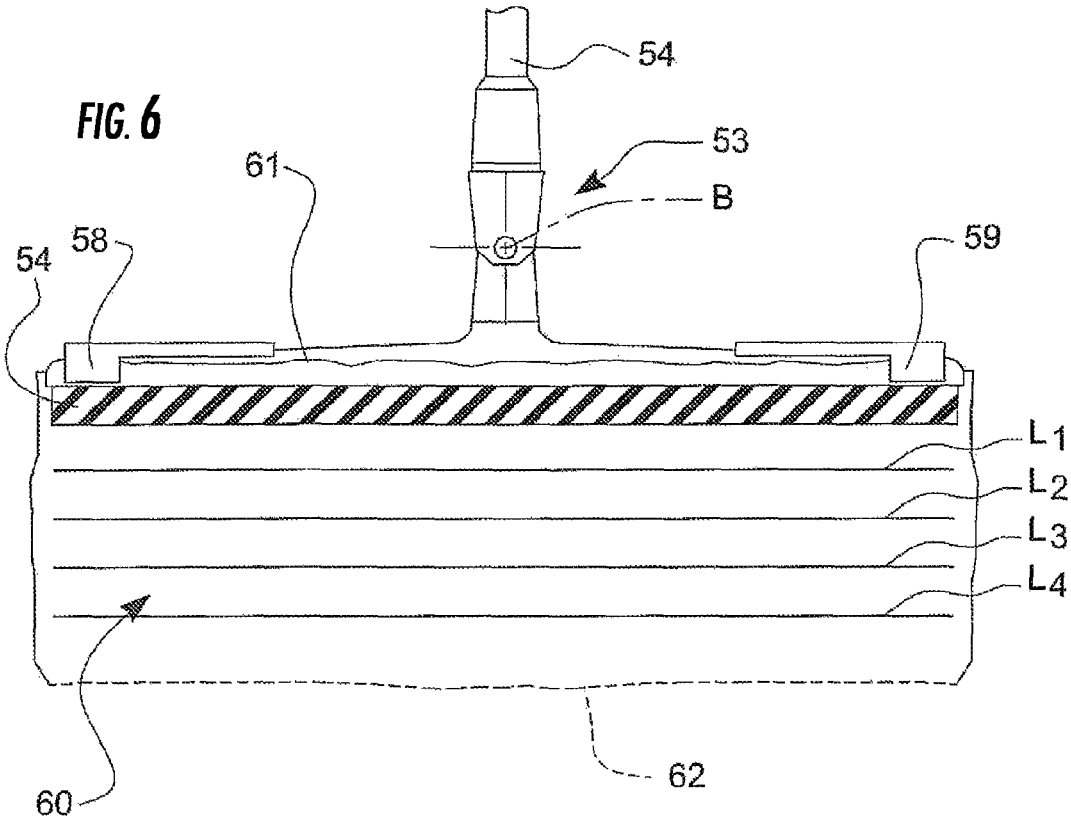

METHOD OF AND APPARATUS FOR CLEANING A FLOOR

CROSS-REFERENCE TO RELATED APPLICATIONS

This application claims priority from U.K. Patent Application No. GB 905953.5, filed Mar. 25, 2009.

BACKGROUND OF THE INVENTION

This invention relates to a method of cleaning a floor and to an apparatus for cleaning a floor.

There are several different kinds of mops, one of the most widely used including a mop head to which a handle is secured, the mop head carrying a plurality of absorbent filaments e.g. of string, which depend from the mop head. The filaments are in use, wetted with a cleaning liquid, wrung out with a wringer, and then the mop is used to clean the floor, whilst still in a wet condition.

Although mechanically assisted wringers which include mechanically moveable jaws which press down on the filaments can wring out most of the cleaning liquid, such mops when wrung out, are still wetter than is ideally required, and a cleaned floor thus remains wet after cleaning, for typically at least several minutes, which during that time, presents a slipping hazard.

Another kind of mop includes a generally flat mop head to an upper side of which a handle is secured, and which carries on its lower side, absorbent fabric material. Flat mops are preferred in some applications, because of their ability to be used for simultaneous sweeping and mopping for example. Mops of the depending filament kind are not good at retaining loose dirt and a floor to be cleaned with such a mop generally requires sweeping first, to remove loose dirt. A flat mop tends to be more versatile in such situations.

A flat mop head typically includes a pair of relatively foldable parts. When these are relatively folded together, a loop of the fabric material depends from the mop head and once wetted with a cleaning liquid in a container, this loop may be introduced into a wringer for wringing prior to use for cleaning a floor. However hithertofore, moveable jaw wringers which enable wringing to be carried out with mechanical assistance, have been designed for general wringing for different sizes and kinds of mop head, and have not enabled all of the absorbent fabric material of a flat mop to be wrung out, and so again, such flat mops have been used in a wetter condition that is ideally required.

SUMMARY OF THE INVENTION

According to a first aspect of the invention we provide a method of cleaning a floor. The method may use a flat mop which includes a generally flat mop head to an upper side of which a handle is secured, and which carries on a lower side, absorbent fabric material. The mop head may include a pair of relatively foldable parts which are foldable together to a folded condition, in which folded condition a loop of the fabric material depends from the folded parts of the mop head. The method may include, with the mop head in a folded condition, inserting at least a major proportion of the absorbent fabric material into a container containing a cleaning liquid to wet the absorbent fabric material, then introducing the mop head to a wringer, the wringer including a pair of jaws which are moveable with mechanical assistance to act upon substantially all of the absorbent fabric material to wring the fabric material between the jaws and a wringing surface of the wringer. The method may include returning the mop head to an unfolded flat condition and using the damp absorbent fabric material to mop the floor. Subsequently the floor is dried using a separate drying tool, the drying tool including a head secured to a handle, and one or more attachment devices to attach a dry absorbent cloth to the head. The method may include drying the floor by applying the cloth to the floor using the tool by moving a dry portion of the cloth over the floor. When the flat mop head foldable parts are relative folded together, the folded head will have a folded thickness which will be at least as great as the combined thicknesses of the folded parts and including any space between them.

The method of the present invention enables a cleaning operative to clean a floor leaving it substantially dry, rather than in a wet state as with known methods, thus reducing the risk of a person slipping on the floor, and minimising the use of "wet floor" warning signs which commonly are used and themselves provide hazards.

This is achieved because the jaws of the wringer act on and thus wring substantially all of the absorbent fabric material so that the fabric material is only just damp when the floor is cleaned. No pools of liquid are thus left by the mop (or by a squeegee which is sometimes used to move residual liquid over the floor in an effort to promote faster floor drying), and accordingly the floor may efficiently be dried by the separate drying tool. If the floor after mopping was too wet, the dry cloth of the drying tool would too readily become wet and rapidly require replacement or drying.

According to the method of the invention, the wringer thus may be designed to co-operate with a specific kind and size of flat mop head rather being of a more-general design. Any disadvantage this may present in terms of the versatility of use of the wringer, is offset by the advantage of being able to clean a floor and leave it substantially dry.

The method steps described above may be the sole steps for cleaning the floor. However, the floor may be pre-cleaned e.g. by sweeping and/or wet washing as required. However after the method steps of the invention has been performed, the floor will be substantially dry and available for use without presenting a slipping hazard, more or less straight away.

In a typical prior art wringer, the jaws would not be moveable together so much that the distance between the jaws would be as small as the folded thickness which is why it is not possible with a known wringer for the jaws to act upon substantially all of the absorbent fabric material of the loop.

In the present invention, the wringer may be designed so that the jaws are moveable together by operation of a wringer mechanism, to a closed condition in which the distance between the jaws, or at least the widest distance between them, is reduced compared with previous proposals, for example so that their distance or widest distance apart when fully closed together, is not significantly greater than the folded thickness of the foldable parts of the mop head including any space between them, and preferably is less than the folded thickness, so that the jaws may act upon substantially all of the absorbent fabric material to wring the fabric material between the jaws and the wringing surface of the wringer.

Thus the method of the invention may include operating a wringer mechanism of the wringer to move the jaws of the wringer from an open condition when the absorbent fabric may be introduced into the wringer, towards a fully closed condition when the distance or widest distance between the jaws is not significantly greater than the folded thickness of the foldable parts of the mop head.

The method may include, when drying the floor with the drying tool, moving the head of the tool over the floor and urging the head towards the floor with a first region of the cloth between an operating edge of the drying tool head, and the floor, adjusting the position of the operating edge relative to the cloth, and performing further drying by moving the head over the floor and urging the head towards the floor with a second region of the cloth between the operating edge and the floor.

The method may include yet further adjusting the position of the operating edge relative to the cloth, and performing further drying by moving the head over the floor and urging the head towards the floor with a third region of the cloth between the operating edge and the floor.

To facilitate this, the head of the drying tool, and the operating edge (or there may be multiple edges), may be elongate and the method may include operating the or each attachment device to attach the dry absorbent cloth to the head along one side of the cloth, and wrapping an opposite free side around the operating edge to bring a selected region of the cloth which extends in the direction of the operating edge, into congruence with the operating edge.

Thus the selected region of the cloth is in use, between the operating edge of the drying tool head, and the floor. This adjusting of the position of the cloth relative to the operating edge, is most easily carried out with the cloth in contact with the floor between the head and the floor, the adjustment being performed by raising the operating edge off the cloth beneath and re-positioning the operating edge over the or the next selected region of the cloth.

If desired, the cloth could be marked with lines on an upward facing face, which lines are each generally parallel to each other and to the one side which is attached to the drying tool head, the lines indicating regions of the cloth that may be selected by repositioning the operating edge over the lines. Thus the same cloth can be used for some time, by adjusting the position of the cloth relative to the operating edge so that when a selected region of the cloth e.g. represented by one of the lines, between the operating edge and the floor, is too damp still to perform drying, a fresh dry region of the cloth can be selected and the operating head re-positioned over the next line, and drying continued.

The drying cloth may have a first face and a second face, each of highly absorbent material, and a moisture resistant, or moisture proof membrane between the first and second sides.

Thus the cloth may be used on the floor in a first orientation with the first face uppermost, when the region or regions of the second face may be used for drying until the second face is too damp effectively to dry the floor, and then the cloth may be used in a second orientation with the second face uppermost.

To change the orientation of the cloth, the or each attachment device may need to be operated to re-attach the cloth to the head to change its orientation relative to the head, or the free side of the cloth could simply be wrapped around the head another way to invert the cloth on the floor relative to the head.

The container for the cleaning liquid may be carried on wheels which may be integral with the container, or provided as a separate dolly. The wringer may be carried by the wheeled container, and the flat mop and/or the drying tool may be carried with the wheeled container and/or wringer, to the floor to be cleaned, by wheeling the container to the floor.

According to a second aspect of the invention we provide an apparatus for use in cleaning floors, e.g. by the method of the first aspect of the invention. The apparatus may include a flat mop which includes a generally flat mop head to an upper side of which a handle is secured, and which carries on a lower side, absorbent fabric material. The mop head may include a pair of relatively foldable parts which are foldable together to a folded condition, in which folded condition a loop of the fabric material depends from the folded parts of the mop head. There may be a container containing in use a cleaning liquid in which the absorbent fabric material may at least partially be inserted to wet the absorbent fabric material, and a wringer which includes a pair of jaws which are moveable with mechanical assistance when the loop is introduced into the wringer, to act upon substantially all of the absorbent fabric material in the wringer to wring the fabric material between the jaws and a wringing surface of the wringer. The pair of jaws may be moved by a wringer mechanism of the wringer between an open position when the absorbent mop fabric material loop may be introduced between the jaws into the wringer towards the wringing surface, and a fully closed position when the jaws together press substantially all the absorbent fabric material towards the wringing surface. The jaws of the wringer may be moveable together by operation of the wringer mechanism, to a fully closed condition in which the distance between the jaws, or at least the widest distance between the jaws, is reduced compared with previous proposals, for example so that the distance or widest distance apart when fully closed together, is not significantly greater than the folded thickness of the foldable parts of the mop head including any space between the folded parts, and preferably is less than the folded thickness, so that the jaws may act upon substantially all of the absorbent fabric material to wring the fabric material between the jaws and the wringing surface of the wringer.

By providing an apparatus in which the jaws act upon substantially all the absorbent fabric material in the wringer, the absorbent fabric material of the flat mop is wrung out so as to be only just damp.

The fabric material of the flat mop may be wider than the foldable parts, and thus when the foldable parts are folded together, the loop of material may include shoulders adjacent to the foldable parts.

In one arrangement, the jaws, or one of the jaws, may include side parts which act on the shoulders to ensure wringing of substantially all the fabric material. When the jaws are closed together, the side parts of one of the jaws thereof may overlap or nearly so with opposite side parts of the other jaw. Thus the closed jaws and side parts may present a gap generally corresponding to the cross sectional shape and area of edges of the folded parts of the mop head and any space between them.

Typically, no part of the mop head will be introduced between the jaws during wringing, but only the loop of absorbent material so that a gap with shape and area less than the cross sectional area of the folded parts may be provided when the jaws are fully closed, to facilitate substantially all of the absorbent material being wrung out.

The wringer may include a wringer basket having a plurality of walls with openings to allow liquid wrung from the absorbent fabric material to drain through. The wringer typically is carried on the container.

The container for the cleaning liquid may be carried on wheels. The flat mop may be carried with the container and/or wringer when not in use, and thus may be transported by wheeling the container, to the floor to be cleaned.

The apparatus may include a separate drying tool, the drying tool including a head secured to a handle, and one or more attachment devices to attach a dry absorbent cloth to the head. The head of the drying tool may mount an operating edge or edges which co-operate with the cloth to effect drying of the floor when the drying tool is moved over the floor with the cloth between the operating edge or edges and the floor.

The head of the drying tool, and the or each operating edge, may be elongate and the absorbent cloth may be attached to the head along one side of the cloth. A side of the cloth opposite to the one side may be wrapped around the or each operating edge to bring a selected region of the cloth which extends in the direction of the operating edge, into congruence with the operating edge or edges.

If desired, an upward facing face of the cloth could be marked with lines which are each generally parallel to each other and to the one side which is attached to the drying tool head, the lines indicating regions of the cloth that may be selected by repositioning the operating edge over the lines.

The or each operating edge is preferably provided by a strip of resilient material, such as for example one or more strips of a neoprene of other rubbery material, which complies with the floor as the drying tool is moved over the floor. Using such a resilient material for the operating edge or edges has been found most efficiently to operate the cloth to effect maximum floor drying.

In one example, the head of the drying tool presents an, in use, downwardly facing opening, the resilient material is folded into a channel shape and received in the opening of the head, with channel limbs extending downwardly, so that a pair of operating edges are provided by the pair of lower edges of the channel limbs.

The wheeled container and/or wringer may include a mounting for the drying tool so that the drying tool may be transported to a floor to be cleaned by wheeling the container.

The apparatus of the invention may include a receptacle for a store of dry cloths, and as desired, a receptacle for used, wet, cloths.

Thus the apparatus may be a self-contained complete floor cleaning system with container for cleaning liquid, wringer, flat mop, drying tool and cloths.

Various advantages of this invention will become apparent to those skilled in the art from the following detailed description of the preferred embodiment, when read in light of the accompanying drawings.

BRIEF DESCRIPTION OF THE DRAWINGS

Embodiments will now be described with reference to the accompanying drawings in which:—

FIG. 5A is an illustrative side cross sectional view showing the configuration of absorbent fabric material of a flat mop head in the wringer of FIG. 5 during wringing;

FIG. 6 is a front illustrative view of part of a drying tool of the apparatus of the invention;

DETAILED DESCRIPTION OF THE PREFERRED EMBODIMENT

Figure 1:
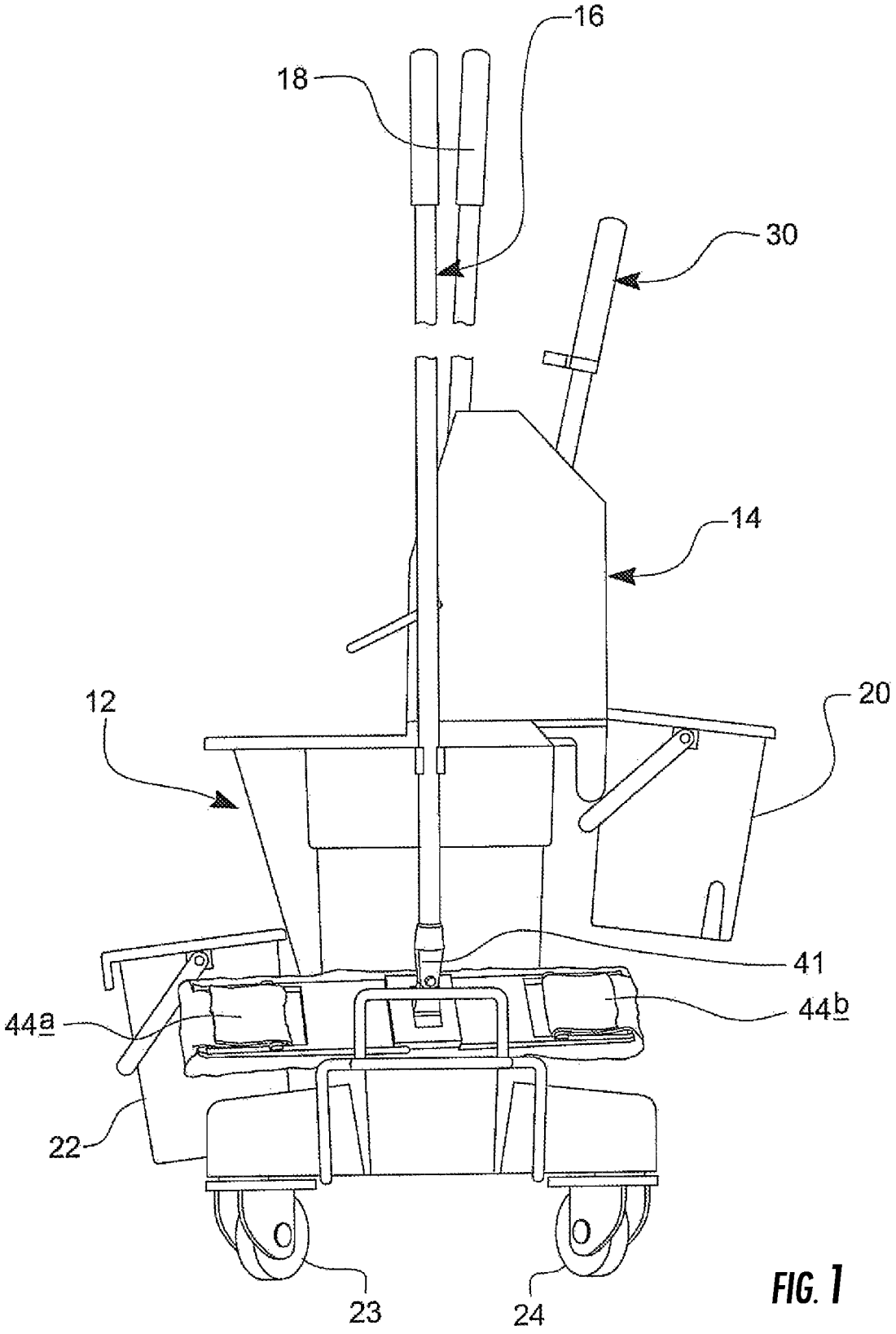
FIG. 1 is a an illustrative view of one side of an apparatus for cleaning a floor for use in the method of the invention.
Figure 2:
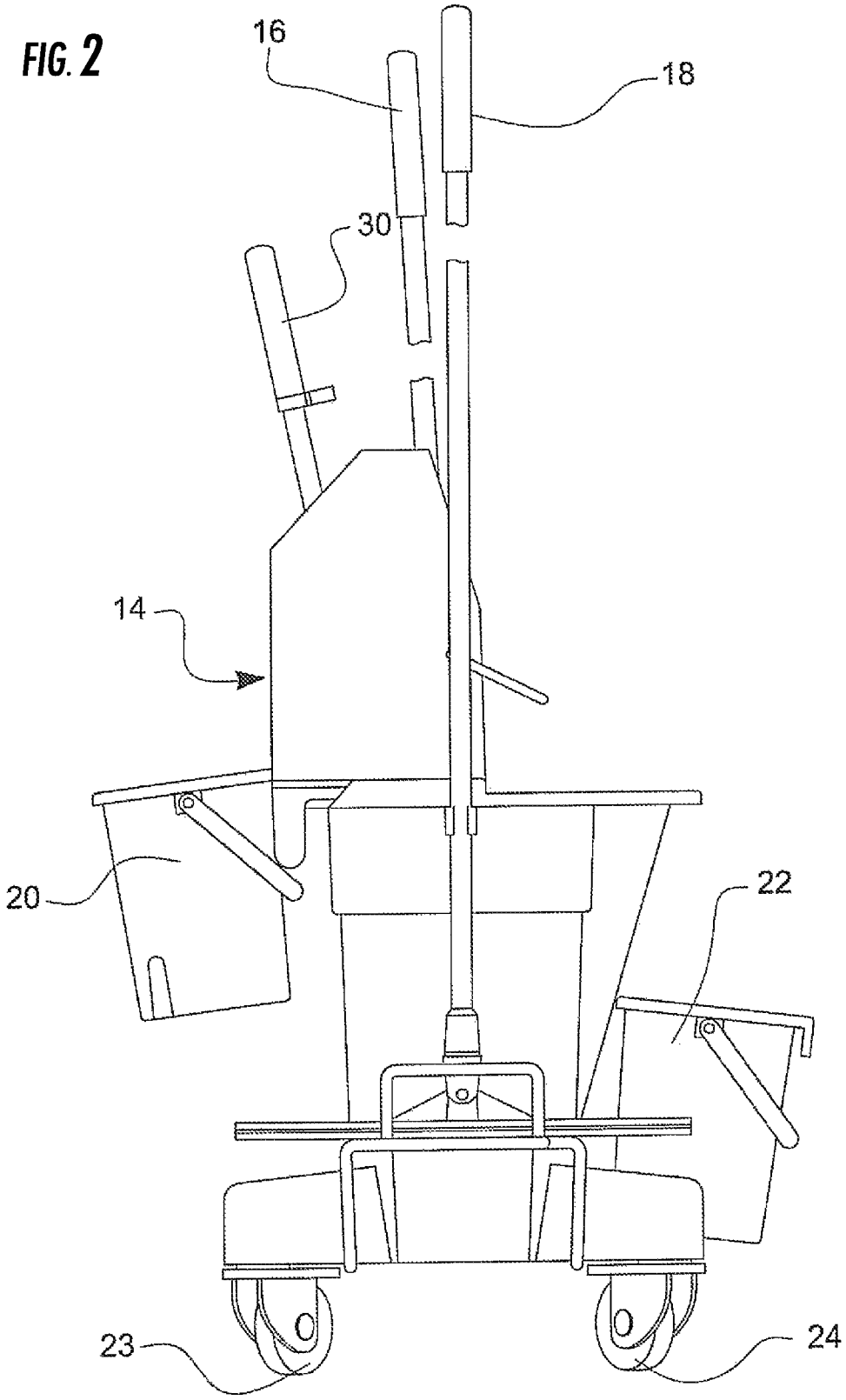
FIG. 2 is an illustrative view of an opposite side of the apparatus.

Referring to FIG. 1 an apparatus 10 for cleaning a floor is shown, which apparatus 10 is generally self contained, and includes a container 12 for containing a floor cleaning liquid, a wringer 14 carried by the container 12, a flat mop 16, and a drying tool 18. The apparatus 10 further includes a receptacle 20 for a store of floor drying cloths, and a receptacle 22 for used, wet, floor drying cloths.

The container 12 is typically provided by a plastic moulding, to which two pairs of wheels 23, 24 may be mounted, or the container 12 may be assembled to a separate wheeled dolly, or the container 12 may otherwise be carried on wheels 23, 24 which enable the container 12 to be wheeled to a floor to be cleaned, typically with floor cleaning liquid contained in the container.

The wringer 14 is integral with the container 12, or is mounted on an upper rim of the container 12, and/or is partially mounted in the container and/or over the rim. In each case the wringer 14 is carried by the container 12 and is thus wheelable with the container 12 to the floor to be cleaned.

The wringer includes a wringer basket 25 (see FIG. 5) which has a one or more walls with openings therein which enable liquid to drain through into the container 12 beneath.

Figure 5:
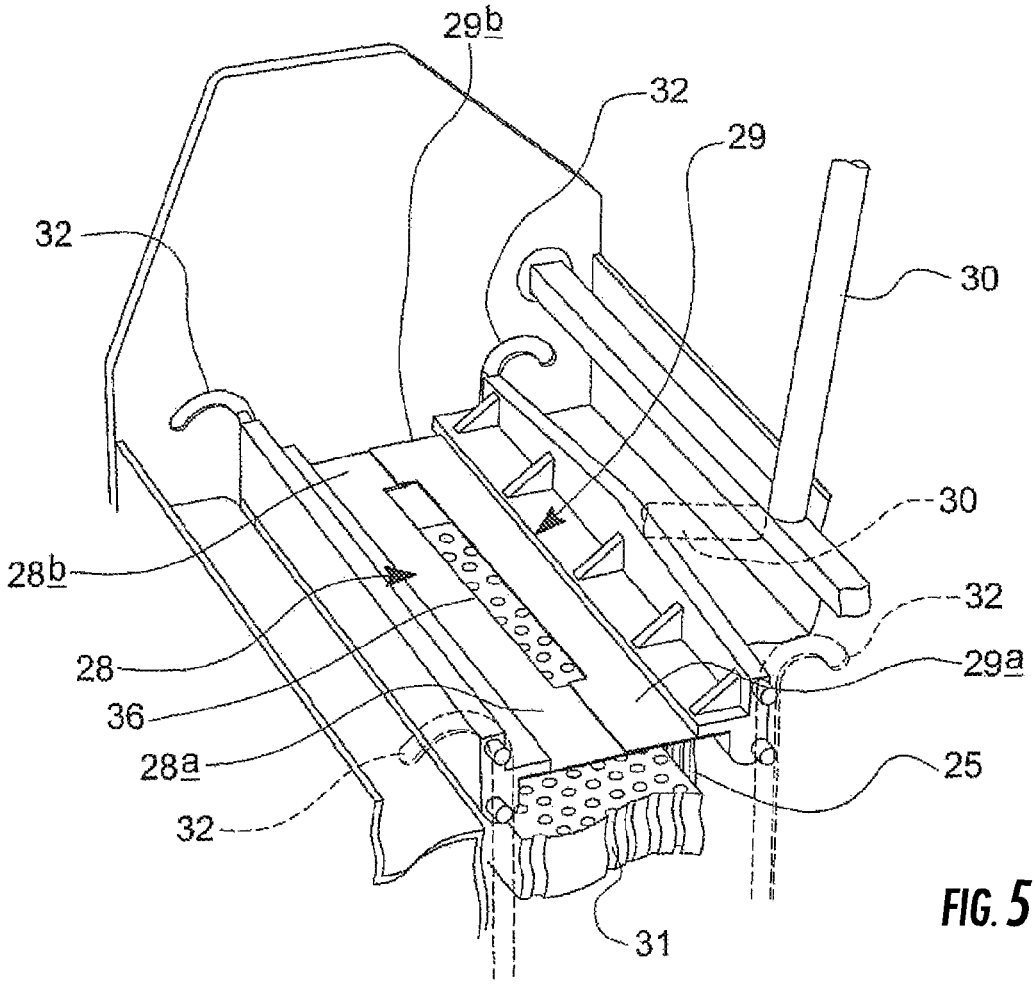
FIG. 5 is an illustrative perspective view from the top and side of a wringer for use in the invention.

The wringer 14 is of the kind which has a pair of moveable jaws 28, 29. In FIG. 5 the jaws 28, 29 are shown in a fully closed condition to which the jaws 28, 29 are moved with mechanical assistance, through operation of a wringer mechanism which in this example includes a wringer handle 30. The handle 30 is shown illustrated in FIG. 5 in full lines when the jaws 28, 29 would be open and in dotted lines, which is the lowered handle position when the jaws 28, 29 are fully closed. When the lowered handle 30 is released, springs of the wringer mechanism (not shown), return the handle 30 to a more upright position and the jaws 28, 29 move apart, guided by guide slots 32 of the mechanism to a fully open condition when material to be wrung out can be introduced between the jaws 28, 29, and wrung-out material can be removed.

When the handle 30 is moved down to the dotted line position shown, the jaws 28, 29 close together and exert a downwards wringing force on material introduced between the jaws 28, 29, pressing the material into contact with a wringing surface beneath the jaws 28, 29, provided in this example, by an insert 31 (see FIG. 5*a*) which is located in the bottom of the basket 25.

The insert 31 is in the example, of a semi-rigid resilient material which has through drainage openings.

The general operation of such wringers 14 is well known and a fuller general description of the mechanism and its operation is not included.

In a typical conventional wringer (see FIG. 4B), when the jaws 28, 29 are closed fully together, a wide gap 36 will be provided between the jaws 28, 29 which will be wide enough to accommodate a wide variety of mop heads. Typically the gap 36 would accommodate at least part of the mop head e.g. a mop head to which is attached a plurality of filaments of absorbent material, and the jaws 28, 29 when closed will act on the filaments, to effect wringing of the filaments. In FIG. 4B it can be seen that the jaws 28, 29 of the prior art wringer when closed fully together present the gap 36 which is significantly wider than the folded thickness T a pair of foldable parts 45*a*, 45*b* of a mop head 38 of the flat mop 16, as will be described below.

As can be seen from FIG. 5, in the arrangement of the invention, the gap 36 when the jaws 28, 29 are closed is considerably smaller than conventionally is provided, so that the wringer 14 is adapted for specific use with the flat mop 16.

Figure 3:
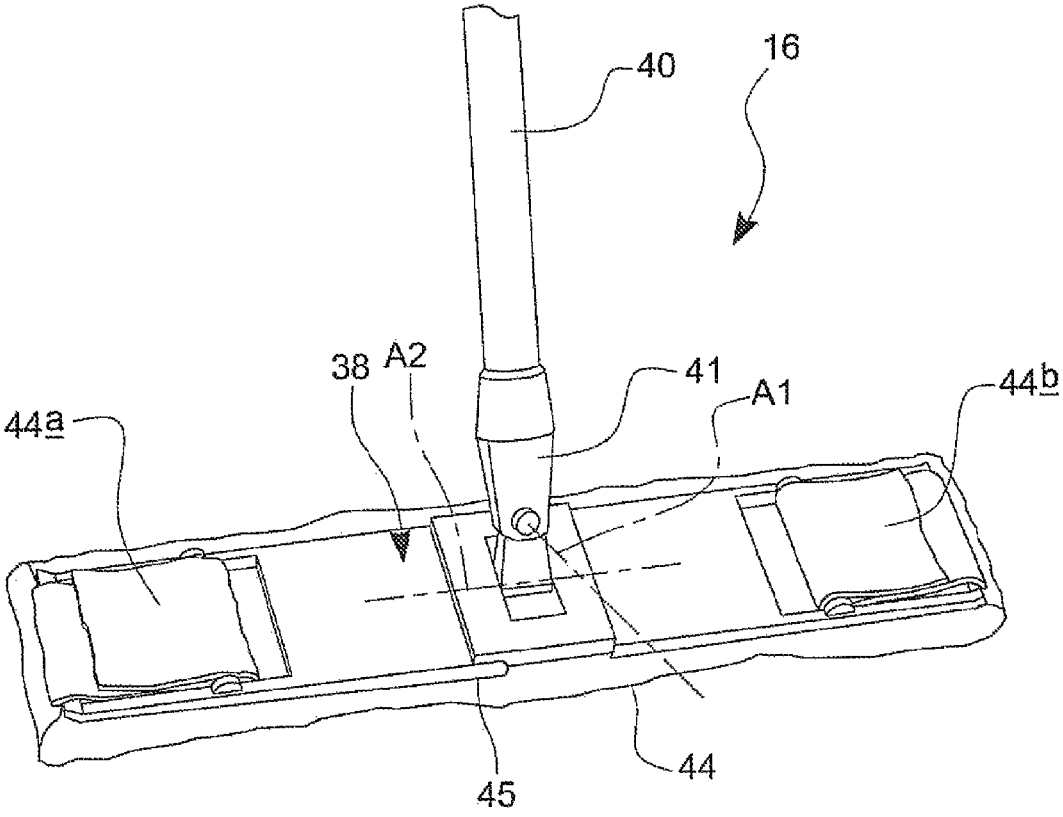
FIG. 3 is a perspective illustrative view of a flat mop in an unfolded condition.

In FIG. 3 the flat mop 16 is shown. This includes a mop head 38 to which is secured a handle 40. A socket 41 is provided for the handle 40, and there is a universal joint (details not shown) which enables the socket 41 and hence the handle 40 to move relative to a floor over which the mop 16 is moved, about a pair of mutually perpendicular axes indicated at A1 and A2. In another arrangement the handle 40 could otherwise be secured to the head 38 for more limited movement e.g. about a single axis, or it may even be secured by being integral with the head 38 so that more limited movement or no movement between handle 40 and head 38 can be effected.

Figure 4:
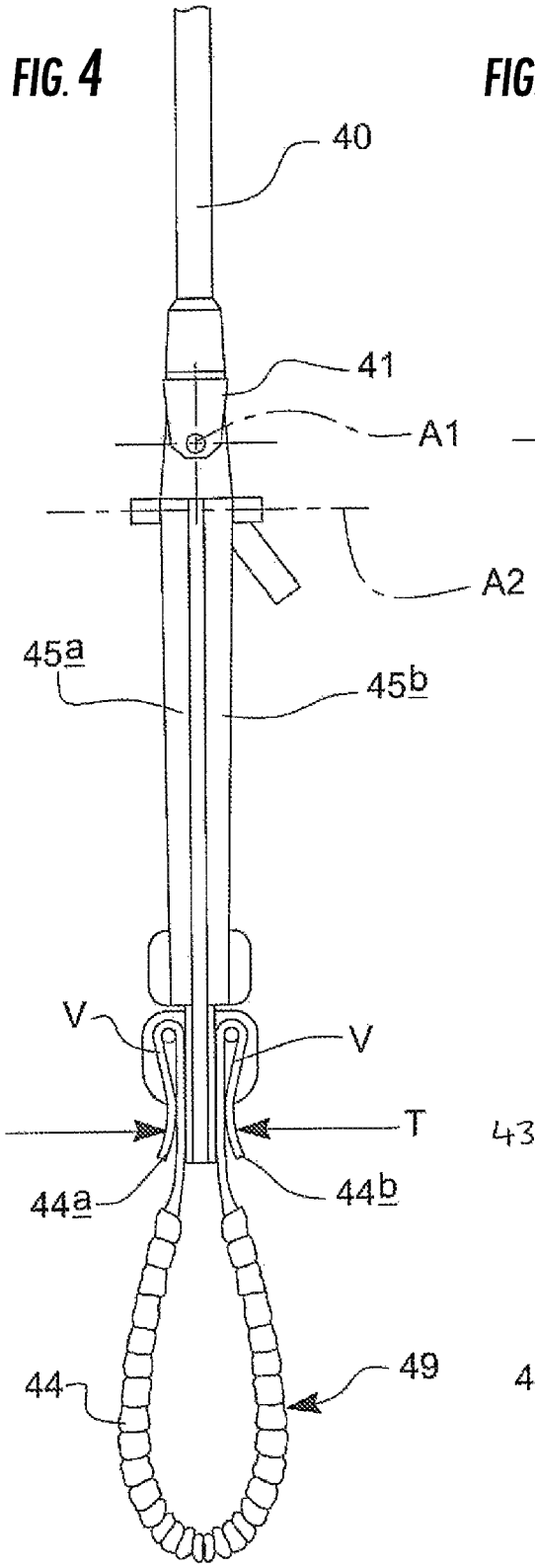
FIG. 4 is an end view of the flat mop of FIG. 3 in a folded condition.

The mop head 38 further includes a pair of foldable parts 45*a*, 45*b* which are relatively foldable together as indicated in FIG. 4.

Absorbent fabric material 44 is attached to the mop head 38, and extends along a lower side 45 of the mop head 38 provided by each of the foldable parts 45*a*, 45*b*, and a body part 48 between them. The absorbent fabric material is provided as a an elongate sheet of absorbent material 44, with ends 44*a*, 44*b* of the material 44 wrapping around the extreme edges of the foldable parts 45*a*, 45*b* and being attached by e.g. fasteners and/or glue and/or clips, or in the example shown, being wrapped around fixings of the mop head 38 and having Velcro® type connections as shown at V in FIG. 4.

Figure 4A:
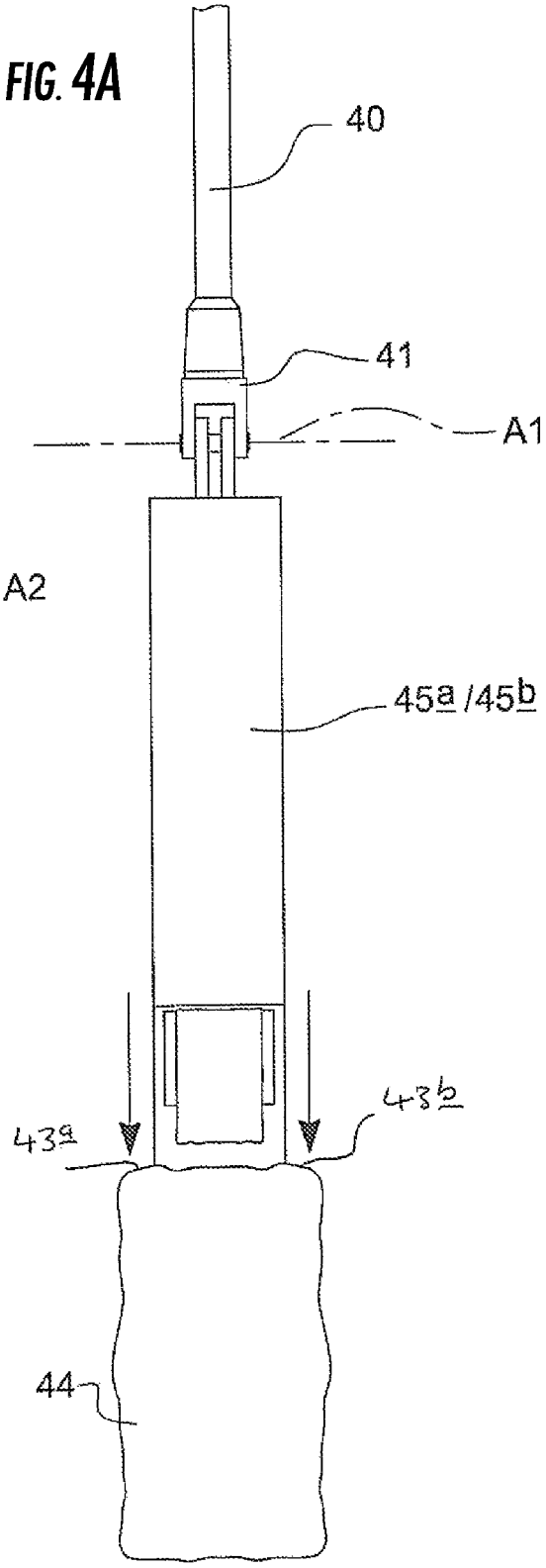
FIG. 4A is a side view of the flat mop of FIG. 4.
Figure 4B:
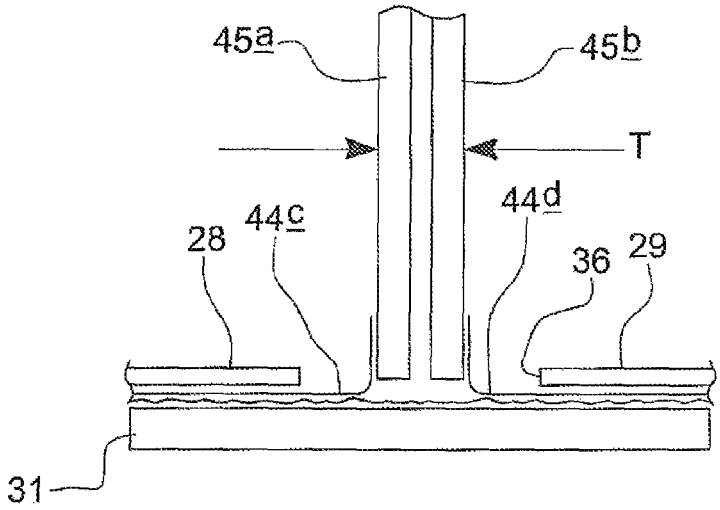
FIG. 4B (PRIOR ART)
FIG. 4B is an illustrative front view of a flat mop head being wrung by a conventional prior art wringer.

When the foldable parts 45*a*, 45*b* are folded together, downwards as indicated in FIGS. 4 and 4A (both foldable parts 45*a*, 45*b* in this example are pivoted to the body part 48 of the mop head 38) the absorbent fabric material 44 will depend from the foldable parts 45*a*, 45*b* in a loop 49. This loop 49 may in this condition conveniently be inserted in to the cleaning liquid in the container 12 for wetting, and may be wrung out as will be described below to remove cleaning liquid and leave the absorbent fabric material in a damp condition.

Using a conventional wringer (again see FIG. 4B) in which moveable jaws 28, 29 when closed together provide a wide gap, i.e. a gap 36 which is significantly wider than the combined folded thickness T of the folded parts 45*a*, 45*b* of the mop head 38 (plus any space S between the folded parts 45*a*, 45*b*), the jaws 28, 29 are unable to act on all of the absorbent material 44 of the loop 49, as the jaws 28, 29 do not act on the areas of the material 44 immediately adjacent the folded parts 45*a*, 45*b* indicated in FIG. 4A at 44*c*, 44*d*.

However, in accordance with the invention, the wringer 14 is designed so that the gap 36 between the closed jaws 28, 29 is only just wider, or is less wide than the folded thickness T of the folded foldable parts 45*a*, 45*b*, and thus the jaws 28, 29 can act on substantially all the absorbent fabric material 44 of the mop 16. The actual gap 36 size will depend on the actual size and shape of the mop head 38 and fabric material 44, but for example, the gap 36 may at its widest be only ⅛" (3.12 mm) or at least not greater than 1/1;2" (12.7 mm) or preferably not greater than 1/1;4" (6.35 mm).

It can be seen that the jaws 28, 29 each have additional side parts 28*a*, 28*b*; 29*a*, 29*b* which close together, and in this example actually overlap, as the jaws 28, 29 are fully closed, either side of the gap 36 through which the absorbent material 44 in use extends. Closing of the sides of the gap 36 in this way which otherwise would extend for the full length of the jaws 28, 29, further ensures that the jaws 28, 29 and the side parts 28*a*, 28*b*; 29*a*, 29*b* act on substantially all of the absorbent material 44 during wringing to ensure that the material 44 is dried to the maximum extent.

In FIG. 4*a* it can be seen that the fabric material 44 is wider than the foldable parts 45*a*, 45*b* of the mop head 38, so that when the foldable parts 45*a*; 45*b* are relevantly folded, the material 44 presents shoulders 43*a*, 43*b*. As indicated by the downwardly pointing arrows, the side parts 28*a*, 28*b*; 29*a*, 29*b* act on the shoulders 43*a*, 43*b* during wringing to ensure that substantially all the fabric material 44 is subject to wringing.

In the example, the gap 36 when the jaws 28, 29 are fully closed is together, particularly but not exclusively by virtue of the provision of the side parts 28*a*, 28*b*; 29*a*, 29*b*, is of a shape and area less than the cross sectional size and area of the edges of the foldable parts 45*a*, 45*b* and space S of the mop head 38, so that in use, only the absorbent material 44 extends through the gap 36 which is too small to accommodate the mop head 38.

Thus the wringer 14 described enables a wet flat mop 16 to be wrung out to far greater dryness than has hithertofore been the case with conventional wringers. Accordingly when the mop 16 is used to clean a floor, the floor will be left significantly less wet, i.e. substantially drier than is the case with conventional mops. There is no need to squeegee the floor to move liquid e.g. into pools in an effort to promote faster drying, as less liquid is left after cleaning using the mop 16.

Moreover, because the floor is left dryer, it is worthwhile further drying the floor to substantial dryness, using the drying tool 18.

Referring to FIG. 6, the drying tool 18 includes a head 50 to an upper surface of which is secured, at a raked angle, a handle 52, the upper surface providing a socket 53 and the handle 52 being capable of swiveling movement relative to the head 50, about a pivot axis B, by virtue of a pivotal joint of the socket 53.

The pivotal joint between the handle 52 and head 50 permits the tool 18 to be used with the head 50 maintaining a parallel relationship to the floor whilst the handle 52 can be moved side to side.

The head 50 is elongate, and provides a channel opening which in use, opens downwardly. In the opening an edge member 54 is provided which in the example, is a U-shaped sheet of neoprene or the like rubbery material, the lower edges of the channel limbs of the U-shaped edge member 54 providing a pair of operating edges 55, 56 which in practice will be very close to each other.

The drying tool head 50 carries a pair of attachment devices being clips 58, 59 in this example, by which a drying cloth 60 is in use attached to the head 50. In the example the cloth 60 is generally rectangular, and the clips 58, 59 attach the cloth 60 along one side 61. The free opposite side 62 of the cloth 60 is then passed around the head 50.

The cloth 60 has marked upon it or at least upon a face which in use faces upwardly, a plurality of lines L1, L2 etc. which extend generally parallel to the mop head 50 and the one side 61 of the cloth 60 and indicate discrete cloth regions. Because the opposite side 62 is free, with the cloth 60 on the floor F (see FIG. 7) the operating edges 55, 56 (or at least one of them) can be positioned on the cloth 60 in congruence with any selected of the regions suggested by the lines L1, L2 etc. as required.

Figure 7A:
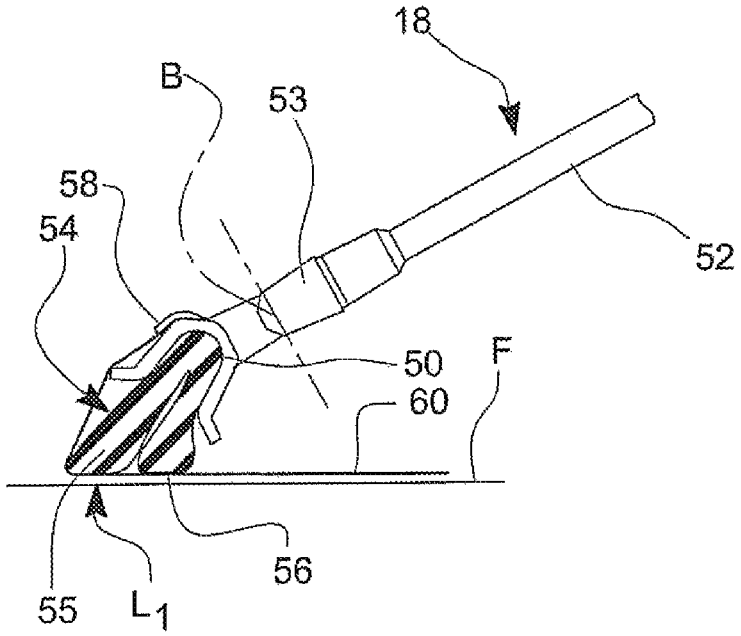
FIGS. 7(A) and 7(B) are alternative illustrative side views of the drying tool of FIG. 6 in use drying a floor.

In FIG. 7(A) the operating edges 55, 56 are shown positioned at a first region in congruence with a first line L1.

The drying tool 18 may then be moved over the floor F forward and back and side to side whilst urging the head towards the floor F, and because of the pivot joint, with the cloth 60 drying the already dryish floor F. As the cloth region L1 becomes wetter, it will be less efficient at drying the floor F.

Figure 7B:
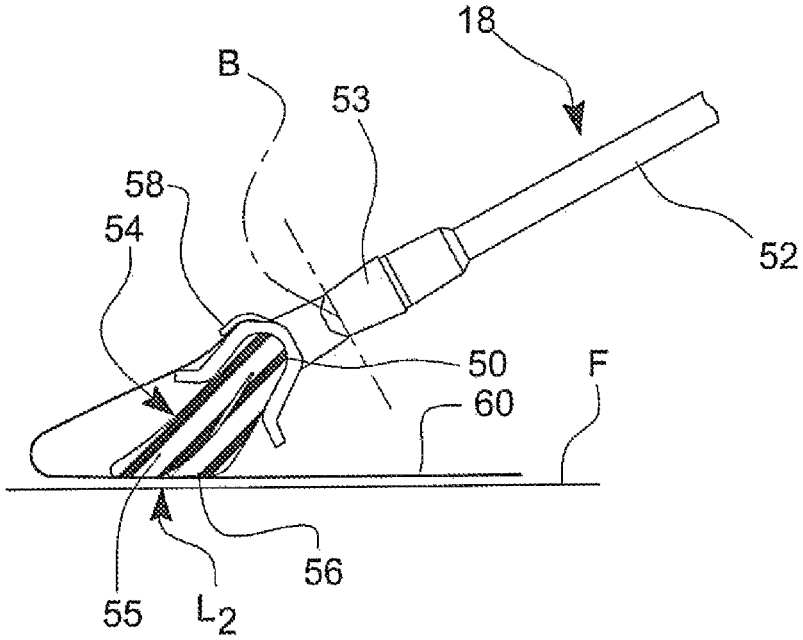

The head 50 of the drying tool 18 can then be re-positioned with respect to the cloth 60 adjacent e.g. the next line L2, so that a different cloth 60 region is selected for further drying, and so forth for all of the regions/lines L1, L2 etc, by raising the head 50 off the cloth 60. In FIG. 7(B) the operating edges 55, 56 are shown positioned in congruence with L2.

Thus the same cloth 60 can be used for a prolonged period, for drying. Because in the first place the floor F is dryer than can be achieved with conventional wet cleaning processes, the cloth 60 does not immediately become wet.

If desired further to prolong the time during which the cloth 60 can be used, the cloth 60 may be double faced. Each face may be of a highly absorbent material, such as a microfibre, and there may be a membrane between the faces.

The membrane may be moisture proof or at least moisture resistant.

Thus when one face of the cloth 60 has been used, with no region of the one face of the cloth still dry enough for drying the floor, the cloth 60 can be inverted and the other face used. This can be achieved by operating the attachment devices 58, 59 and reversing the cloth 60, or simply wrapping the free side 62 the other way around the head 50.

Both faces of the cloth 60 may have lines L1, L2 as required.

The drying tool 18 may be modified compared to the configuration shown. A single operating edge may be provided rather than the pair 55, 56 indicated or more than two operating edges, although the edge or edges preferably are resilient so as to accommodate floor F unevenness, and to grip the selected region of the cloth 60. The single operating edge or multiple edges may be made very wide to maximise the cloth area between the edge or edges combined, and the floor F, for example, up to 3 inches wide.

The cloth 60 need not be attached to the head 50 by clips as shown, but an alternative attachment arrangement could be utilised.

Preferably the operating edge or edges 55, 56 are continuous along the head 50, but need not be. The handle 52 may be universally moveable relative to the head 50, or not relatively movable at all.

The cloth 60 need not have the lines L1, L2 etc. marked thereon.

When it is necessary to replace a cloth 60, the clips or other attachment device(s) are operated to release the side 61, and the cloth 60 may be disposed of, but preferably the cloth 60 is washed and cleaned for reuse. Used cloths 60 may be placed in the used cloth receptacle 22 carried with the container 12.

A fresh dry cloth 60 e.g. from the store in the receptacle 20 may then be attached to the drying tool 18 and used for further floor drying.

To enable the mop 16 and drying tool 18 to be carried as suggested in FIG. 1, with the wheeled container 12, the container 12 may have appropriate mounting devices, such as handle clips, and a tray or wire/plastic formation to receive respectively the mop head 38 and the drying tool head 50.

The store of dry cloths 60 may be carried by a cleaning operative instead of in a receptacle 20 being provided. Where used wet cloths are disposed of, they may be put in a bin rather than the receptacle 22 shown in FIG. 1. Alternatively, a used recyclable cloth may be taken to a washing/drying station otherwise than via a receptacle 22 carried with the container 12.

In another example, an attachment device may be provided by urging the first cloth edge 61, between the channel limb 50*a* and the edge member 54 so that the cloth 60 instead of extending in front of the drying tool 18, and then rearwardly beneath the operating edge or edges 55, 56 as indicated in the drawings, the cloth 60 extends behind the head of the drying tool 18, then forwardly beneath the operating edge or edges 55, 56.

The cloth edge 61 will be held in position by the resilience of the edge member 54.

Various other modifications are possible without departing the scope of the invention as will apparent to a person skilled in the art.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An apparatus for use in cleaning floors, the apparatus including a flat mop which includes a flat mop head to an upper side of which a handle is secured, and which carries on a lower side, absorbent fabric material, the mop head including a pair of relatively foldable parts which are foldable together to a folded condition, in which folded condition a loop of the fabric material depends from the folded parts of the mop head, a container containing in use a cleaning liquid in which the absorbent fabric material in use is at least partially inserted to wet the absorbent fabric material, a wringer which includes a pair of jaws which are moveable with mechanical assistance when the loop of fabric material is introduced into the wringer, to act upon substantially all of the absorbent fabric material in the wringer to wring the fabric material between the jaws and a wringing surface of the wringer, the pair of jaws being moveable by a wringer mechanism of the wringer between an open position when the loop of absorbent mop fabric material is receivable between the jaws into the wringer towards the wringing surface, and a fully closed position when the jaws together press substantially all the absorbent fabric material towards the wringing surface, and the jaws of the wringer being moveable together by operation of the wringer mechanism, to a fully closed condition in which the widest distance between the jaws, is less than the folded thickness of the foldable parts of the mop head, including any space between the folded parts, such that the foldable parts of the mop head are not receivable between the jaws in the fully closed position.

2. An apparatus according to claim 1 wherein the fabric material of the mop is wider than the foldable parts, and at least one of the jaws, includes side parts which act on the fabric shoulders adjacent the foldable parts when the jaws are closed together.

3. An apparatus according to claim 2 wherein both jaws have side parts, the side parts of one of the jaws, when the jaws are closed together, overlap with opposite side parts of the other jaw.

4. An apparatus according to claim 2 wherein the closed jaws and side parts present a gap corresponding to the cross sectional shape and area of edges of the folded parts of the mop head and any space between them.

5. An apparatus according to claim 1 wherein the wringer includes a wringer basket having a plurality of walls with openings to allow liquid wrung from the absorbent fabric material to drain through.

6. An apparatus according to claim 1 wherein the wringer is carried on the container, and the container for the cleaning liquid is carried on wheels.

* * * * *